United States Patent [19]

Davison et al.

[11] Patent Number: 4,893,984

[45] **Date of Patent: * Jan. 16, 1990**

[54] CLEARANCE CONTROL SYSTEM

[75] Inventors: Samuel H. Davison, Milford; William F. McGreehan, Westchester, both of Ohio

[73] Assignee: General Electric Company, Cincinnati, Ohio

[ * ] Notice: The portion of the term of this patent subsequent to Jan. 16, 2004 has been disclaimed.

[21] Appl. No.: 178,721

[22] Filed: Apr. 7, 1988

[51] Int. Cl.[4] ..... F01D 17/00

[52] U.S. Cl. ..... 415/48; 415/116

[58] Field of Search ..... 415/47, 48, 14, 110, 415/116, 175, 176

[56] References Cited

U.S. PATENT DOCUMENTS

| | | | |
|---|---|---|---|
| 3,647,313 | 3/1972 | Koff | 415/115 |
| 3,742,706 | 7/1973 | Klompas | 60/757 |
| 3,844,110 | 10/1974 | Widlansky | 60/39.08 |
| 4,069,662 | 1/1978 | Redinger, Jr. et al. | 60/226 |
| 4,127,988 | 12/1978 | Becker | 60/757 |
| 4,213,738 | 7/1980 | Williams | 416/95 |
| 4,230,436 | 10/1980 | Davison | 415/1 |
| 4,242,042 | 12/1980 | Schwarz | 415/116 |
| 4,268,221 | 5/1981 | Monsarrat et al. | 415/116 |
| 4,329,114 | 5/1982 | Johnston et al. | 415/145 |
| 4,487,016 | 12/1984 | Schwarz et al. | 60/204 |
| 4,576,547 | 3/1986 | Weiner | 415/116 |
| 4,581,887 | 4/1986 | Scheffler et al. | 415/116 |
| 4,648,241 | 3/1987 | Putman | 60/39.29 |

OTHER PUBLICATIONS

CF6 Jet Engine Diagnostics Program, by M. A. Radomski, Jan. 1982.

CFM56-5 Technical Review-Oct. 1986.

*Primary Examiner*—Robert E. Garrett

*Assistant Examiner*—John T. Kwon

*Attorney, Agent, or Firm*—Derek P. Lawrence; Nathan D. Herkamp

[57] ABSTRACT

A system for controlling rotor blade tip clearances in a gas turbine engine supplies both heating air and cooling air to the rotor bore. The heating air flow is controlled by a valve and the cooling air flow is not controlled.

19 Claims, 3 Drawing Sheets

CLEARANCE CONTROL SYSTEM

The present invention is an improved system for controlling clearances in a gas turbine engine by selectively heating or cooling the engine rotor.

BACKGROUND OF THE INVENTION

This Application is related to Application Ser. No. 178,734, filed concurrently herewith.

Gas turbine engines typically include a core engine with a compressor for compressing air entering the core engine, a combustor where fuel is mixed with the compressed air and then burned to create a high energy gas stream, and a first turbine which extracts energy from the gas stream to drive the compressor. In aircraft turbofan engines a second turbine or low pressure turbine located downstream from the core engine extracts more energy from the gas stream for driving a fan. The fan provides the main propulsive thrust generated by the engine.

The rotating engine components of the turbine and compressor include a number of blades attached to a disc which are surrounded by a stationary shroud. In order to maintain engine efficiency, it is desirable to keep the space or gap between the tips of the blades and the shroud to a minimum. If the engine were to operate only under steady state conditions, establishing and maintaining a small gap would be fairly straight forward. However, normal operation of aircraft gas turbine engines involves numerous transient conditions which may involve changes in rotor speed and temperature. For example, during takeoff rotor speed and temperature are high which means that there is a correspondingly high radial expansion of the blades and disc. Similarly, during decreases in engine rotor speed and temperature there is a reduction in the radial size of the blades and disc. The stationary shroud also expands or contracts in response to changes in temperature.

It is difficult to devise a passive system in which the blades and disc move radially at the same rate as the shroud so as to maintain a uniform gap therebetween. This is due in part to the fact that the rotor grows elastically almost instantaneously in response to changes in rotor speed with essentially no corresponding shroud growth. Furthermore, there is a difference in the rate of thermally induced growth between the shroud and rotor. Typically, the thermal growth of the rotor blades lags the elastic growth, and thermal growth of the shroud lags blade thermal growth with disc thermal growth having the slowest response of all.

In the past, various active systems have been employed to control the relative growth between the shroud and rotor and thereby control the gap, for example, selectively heating and/or cooling the stator shroud such as disclosed in U.S. Pat. No. 4,230,436, Davison.

A proposal for controlling clearances in a compressor by selectively heating its rotor is disclosed in U.S. Pat. No. 4,576,547, Weiner. The system disclosed therein shows two sources of relatively high pressure compressor air at different temperatures being selectively admitted into the rotor bore at a mid stage station of the compressor. Control of clearances by continuously cooling a rotor is disclosed in U.S. Pat. No. 3,647,313, Koff.

OBJECTS OF THE INVENTION

It is an object of the present invention to provide a new and improved system for controlling the temperature of a rotor of a turbomachine.

It is another object of the present invention to provide a system for controlling the clearances in a turbomachine by heating or cooling a rotor therein.

It is yet another object of the present invention to provide a simplified system for cooling and heating the rotor of a gas turbine engine.

It is a further object of the present invention to provide a new and improved clearance control system for a compressor of a gas turbine engine which heats or cools the compressor rotor with a minimum loss of efficiency to the engine cycle.

SUMMARY OF THE INVENTION

The present invention is a system for controlling the temperature of a rotor of a turbomachine. The system comprises means for supplying a cooling fluid to the rotor and means for supplying a heating fluid to the rotor and means for controlling only the flow of the heating fluid.

DETAILED DESCRIPTION OF THE INVENTION

Figure 1:
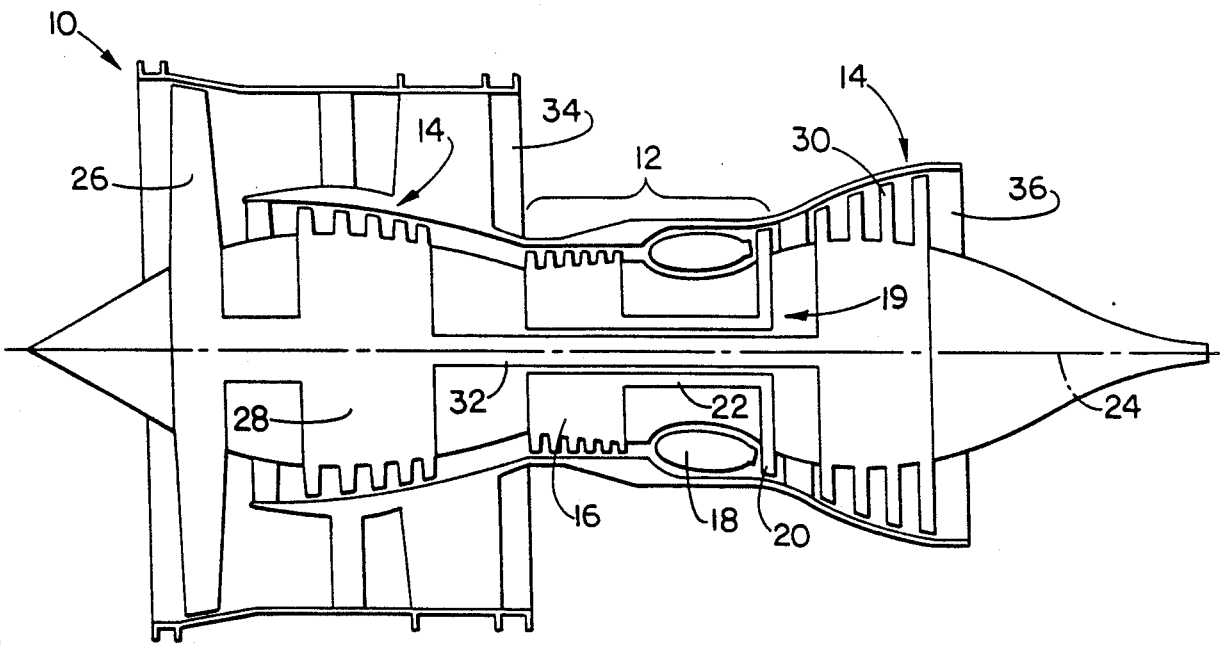
FIG. 1 is a cross sectional schematic view of a gas turbine engine.

FIG. 1 shows a gas turbine engine 10 having a core engine 12 and low pressure system 14. Core engine 12 has an axial flow, high pressure compressor 16, combustor 18 and high pressure turbine 20 in serial flow relationship. Compressor 16 and turbine 20 have rotor sections which are connected by a first shaft 22, which rotate together about engine center line 24. These rotor sections together with shaft 22 and the other rotating elements of core engine 12 comprise rotor 19.

Low pressure system 14 includes a fan 26, axial flow booster compressor 28, and a low pressure turbine 30. As evident from FIG. 1, fan 26 and compressor 28 are located forward of core engine 12 and low pressure turbine 30 is located aft of core engine 12. The rotor sections of the low pressure system components are connected by a second shaft 32 which rotate about engine center line 24.

Air entering core engine 12 first passes through the radially inward portion of fan 26 and through booster compressor 28 where it is compressed thereby increasing its pressure and temperature. The air is further compressed as it moves through high pressure compressor 16. The air is then mixed with fuel in combustor 18 and burned to form a high energy gas stream. This gas stream is expanded through high pressure turbine 20 where energy is extracted to drive compressor 16. More energy is extracted by low pressure turbine 30 for driving fan 26 and booster compressor 28. Engine 10 produces thrust by the fan air which exits fan duct 34 and the gases which exit core nozzle 36.

Figure 2:
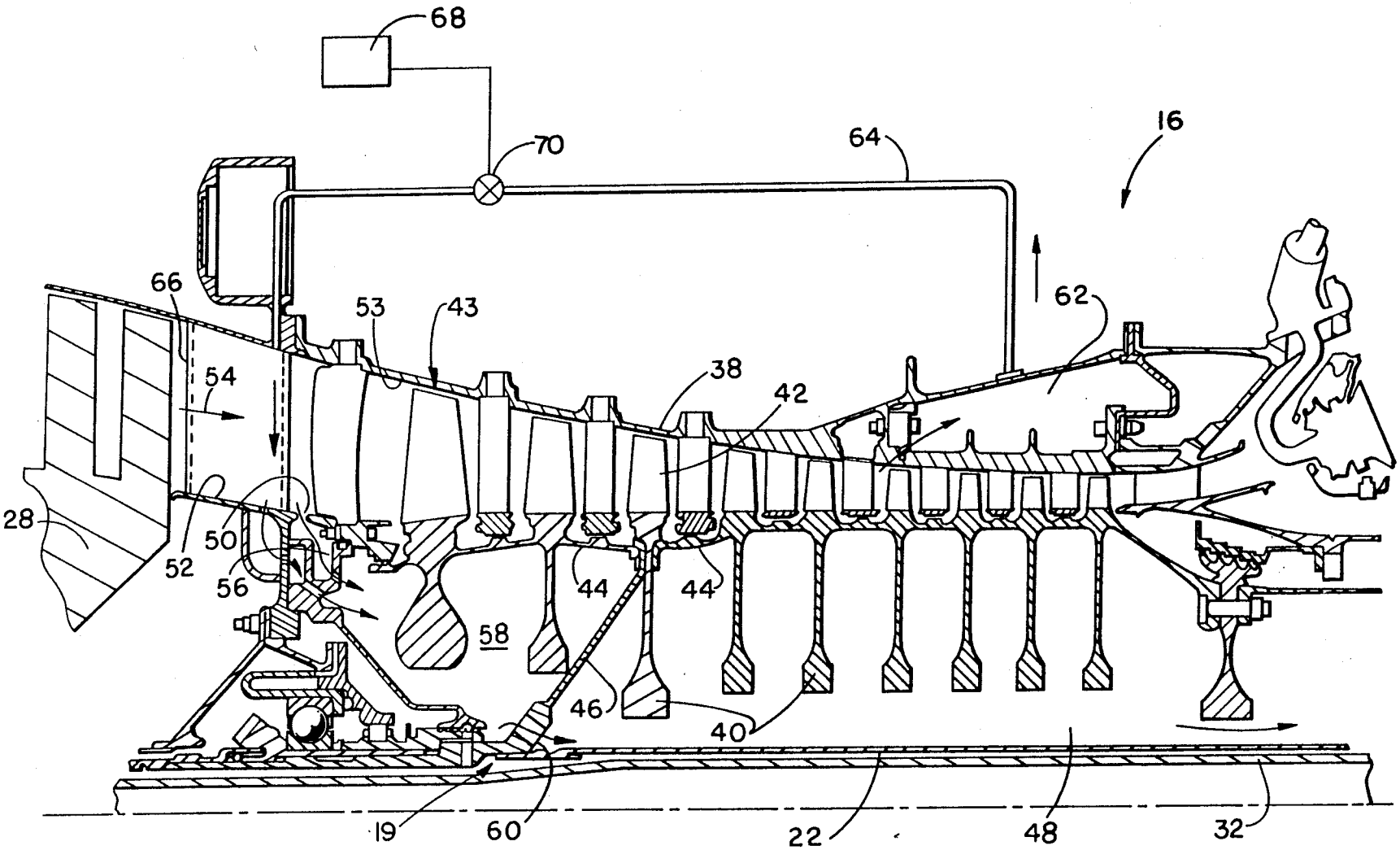
FIG. 2 is a cross sectional schematic view of the high pressure compressor of the engine shown in FIG. 1 which illustrates one form of the present invention.

Referring now to FIG. 2, high pressure compressor 16 has a plurality of discs 40. Each disc 40 supports a plurality of circumferentially spaced compressor blades 42 which define a single compressor stage. The various stages are connected together by members 44 and are connected to tubular shaft 22 by cone or forward support structure 46. These elements of rotor 19 define a rotor bore 48 between shaft 22 and members 44.

Figure 3:
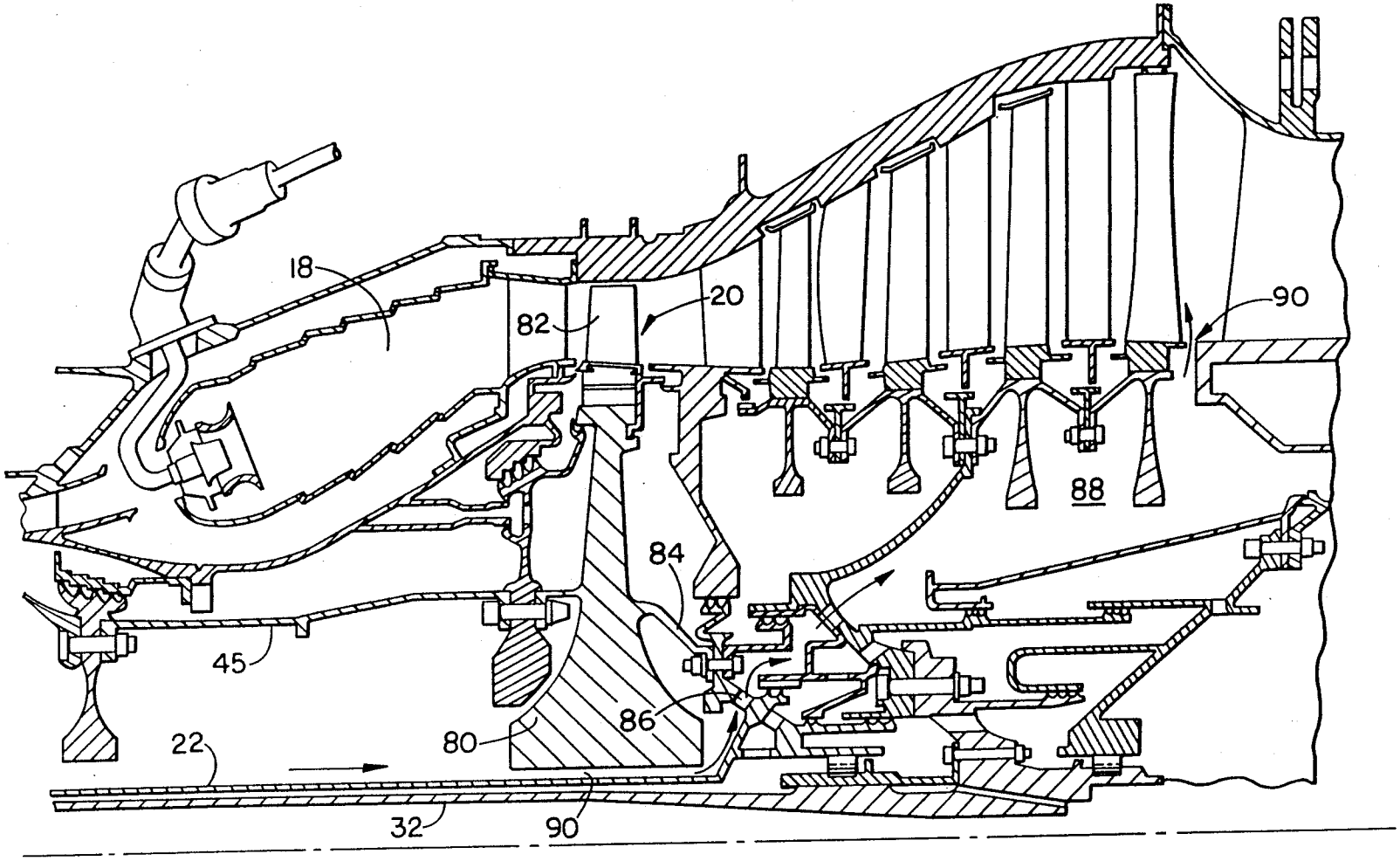
FIG. 3 is a cross sectional schematic view of the high pressure turbine of the engine shown in FIG. 1 which, together with the illustration in FIG. 2, illustrates one form of the present invention.

Referring now to FIG. 3, high pressure turbine 20 includes a disc 80 which supports a plurality of circumferentially spaced turbine blades 82. Disc 80 is connected to the compressor stages by member 45 and is connected to shaft 22 by aft support structure 84.

All of the rotating components of engine 10 are surrounded at their radially outer ends by a stationary shroud structure. For example, as shown in FIG. 2, high pressure compressor 16 is surrounded by shroud 38.

The present invention is a system for maintaining the desired clearance between rotating blades and a surrounding shroud by controlling the temperature of the discs which support the blades. In its broadest form, the system includes means for supplying a cooling fluid to the rotor, means for supplying a heating fluid to the rotor, and means for controlling only the flow of the heating fluid.

In the embodiment of the invention shown in FIGS. 2 and 3, the cooling fluid is air supplied from booster compressor 28. The means for supplying this booster air includes slot 50, manifold 56, common mixing chamber 58 and holes 60. The slot 50 is a preferred form of an opening through which booster bleed air is obtained. Slot 50 is disposed in the radially inner wall 52 of the annular flowpath 54 at a location aft of booster compressor 28 and forward.of high pressure compressor 16. Booster air for cooling of rotor 19 is continuously bled through slot 50. The air is collected in manifold 56 (which is preferably less than a 360° structure but which could be a 360° structure in certain embodiments or even a plurality of discrete manifolds) from where it passes into common mixing chamber 58. Mixing chamber 58 is located forward of support structure 46 and at the forward end of rotor 19. Chamber 58 is fluidly connected to rotor bore 48 by a plurality of holes 60 in forward support structure 46.

Still referring to the embodiment of FIGS. 2 and 3, the heating fluid is compressor air bled from an intermediate stage of the high pressure compressor 16. By supplying air from a location aft of the first upstream high pressure compressor stage 43, higher temperature air is thereby obtained. The means for supplying this compressor air includes manifold 62, tube 64, strut 66, common mixing chamber 58 and holes 60. The air is collected in bleed manifold 62 which is radially outwardly disposed with respect to high pressure compressor 16. A tube 64, external to the radially outer wall 53 of flowpath 54, connects bleed manifold 62 to strut 66, strut 66 being located between booster compressor 28 and high pressure compressor 16. When activated, compressor air flows from manifold 62 through tube 64 and hollow strut 66 and into common mixing chamber 58.

Means for controlling the flow of compressor air includes control logic means 68 and valve 70, valve 70 being disposed within tube 64. Valve 70 is located radially outward of the engine case for ease of assembly, operation, and maintenance.

The invention further includes means for restricting the flow of air to the rotor. According to a preferred form of the invention, such restriction means includes a fixed orifice or orifices in the form of metering holes 86 in aft support structure 84.

In operation, booster air is admitted into rotor bore 48 from flowpath 54 through slot 50, manifold 56, mixing chamber 58 and holes 60. The air flows aft and exits bore 48 through metering holes 86. In the disclosed embodiment the discharged air passes through the low pressure turbine bore cavity 88 before reentering the gas flowpath through slot 90. The air flows continuously and there is no valve to control its flow. The presence of this baseline cooling flow minimizes rotor thermal growth at maximum growth conditions. The absence of a valve also enhances the system's reliability and ensures that air will flow into the bore cavity during all engine operating conditions thereby keeping it purged of unwanted vapors. In addition, since the air is bled internally of flowpath 54 there is no external piping required.

The only valve required in the subject invention is valve 70 which controls only the flow of the high pressure air. When valve 70 is closed no heating air and only the relatively cool booster air reaches bore 48. As valve 70 is partially opened and compressor air flows through tube 64, booster air and compressor air mix in chamber 58 forming an air mixture which passes through holes 60 into bore 48. Metering holes 86 in aft support structure 86 are sized so that the flow therethrough is metered, i.e., at the given operating conditions the size of this orifice establishes the flowrate. This means that the proportion of the booster air in the air mixture is reduced when the flow of compressor air is increased. In other words, as the flow of compressor air increases, the flow of booster air will decrease. Thus, the "control" of compressor air flow through valve 70 has an effect on the amount of compressor air that reaches bore 48. However, it is the sizing of holes 86 that determines the maximum flow of booster air therethrough. Consequently, the terms "control" and "controlling" as used herein refer only to the direct effect on a flow stream such as would be created on the compressor air flow through valve 70 by the mechanical reduction in flowpath cross section. The terms do not refer to any secondary effect such as the dimunition in the flow of booster air into bore 48 as a result of increases in compressor air flow.

As noted, holes 86 are sized so that the flow therethrough is metered. Alternative means for restricting the flow are possible if the sizes of holes 86 in aft support 84 and holes 60 in forward support 46 are adjusted so that holes 60 meter the flow. It is also possible to size the system components so that the flow is metered at yet other locations, for example, annulus 90 between high pressure turbine disc 80 and shaft 22. One advantage of the preferred embodiment is that by having the metering point at the aft end of the rotor bore 48 the pressure in bore 48 is increased thereby achieving improved heat transfer with discs 40.

Various control parameters and logic may be employed to control the setting of valve 70. For example, control parameters may include selected engine operating parameters and/or engine operating conditions. Engine operating parameters may include engine core speed, fan speed, or temperatures or pressures at predetermined engine locations. Engine operating conditions may include altitude, or ambient temperature or pressure. In a preferred embodiment the logic will sense as input both altitude and core speed. The valve will be closed at less than 8000 feet to prevent rubs between the blade tips and shrouds during rapid changes in engine speed. Above 8000 feet the valve will be modulated to allow more flow at lower engine speeds and lower altitude and less flow at higher engine speeds and higher altitudes.

The present invention not only affects clearances in the high pressure compressor but also in the high pressure turbine and low pressure turbine. In the embodiment shown in FIG. 3, only the clearances in the two downstream stages of the low pressure turbine will be affected.

It will be clear to those skilled in the art that the present invention is not limited to the embodiment shown and described herein. It should also be understood that the dimensions and proportional and structural relationships shown in the drawings are illustrated by way of example only and these illustrations are not to be taken as the actual dimensions or proportional structural relationships used in the present invention.

Numerous modifications, variations, and full and partial equivalents can be undertaken without departing from the invention as limited only by the spirit and scope of the appended claims.

What is claimed is:

1. A system for controlling the temperature of a rotor of a turbomachine comprising:

means for supplying a cooling fluid to said rotor;

means for supplying a heating fluid to said rotor; and means for controlling only the flow of said heating fluid.

2. A system, as recited in claim 1, wherein said cooling fluid supply means and said heating fluid supply means include a common mixing chamber at the forward end of said rotor where said cooling fluid and said heating fluid combine to form a fluid mixture.

3. A system, as recited in claim 2, further comprising:

means for restricting the flow of said fluid mixture to said rotor.

4. A system, as recited in claim 3, wherein said restricting means includes a fixed orifice through which said fluid mixture flows.

5. A system, as recited in claim 4, wherein said fixed orifice is sized so that the proportion of said cooling fluid in said fluid mixture is reduced when the flow of said heating fluid is increased.

6. A system, as recited in claim 1, wherein said turbomachine includes forward and aft axial flow compressors, and wherein said rotor is the rotor of said aft compressor and said cooling fluid comprises air which is supplied from a location forward of said aft compressor.

7. A system, as recited in claim 6, wherein said compressors define a generally annular flowpath and wherein said cooling fluid supply means includes an opening on the radially inner wall of said flowpath forward of said aft compressor.

8. A system, as recited in claim 6, wherein said aft axial flow compressor includes a first upstream stage and wherein said heating fluid comprises compressor air which is supplied from a location aft of said first stage.

9. A system, as recited in claim 8, wherein:

said heating fluid supply means includes a tube external to the radially outer wall of said flowpath; and said control means includes a valve disposed within said tube.

10. A system, as recited in claim 9, wherein:

said cooling fluid supply means and said heating fluid supply means include a common mixing chamber at the forward end of said rotor; and said heating fluid supply means further comprises a hollow strut between said forward and aft compressors connecting said tube and said mixing chamber.

11. In a turbomachine which includes forward and aft axial flow compressors, said aft compressor having a plurality of stages, a system for controlling the temperature of the rotor of said aft compressor comprising:

means for supplying air for cooling said rotor from a location forward of said aft compressor;

means for supplying compressor air for heating said rotor from a location aft of the first of said plurality of aft compressor stages;

wherein said cooling and heating air supply means include a common mixing chamber at the forward end of said rotor where said cooling air and said heating air combine to form an air mixture;

means for controlling only the flow of said heating air; and a fixed orifice sized so that the proportion of said cooling air in said mixture is reduced when the flow of said heating air is increased.

12. A system, as recited in claim 11, wherein said compressors define a generally annular flowpath and wherein said cooling air supply means includes an opening on the radially inner wall of said flowpath forward of said aft compressor.

13. In a gas turbine engine having a core engine and low pressure system, said core engine having a high pressure compressor, combustor and high pressure turbine in serial flow relationship, said high pressure compressor and high pressure turbine having a rotor which includes a shaft connecting said compressor and turbine, said rotor having at least one turbine disc in said high pressure turbine and a plurality of compressor discs in said high pressure compressor each of said compressor discs supporting a plurality of compressor blades defining a single compressor stage, said rotor having a rotor bore between said shaft and said discs and a forward support structure forward of said bore for connecting said compressor discs to said shaft and an aft support structure aft of said bore for connecting said turbine disc to said shaft, said low pressure system having a low pressure turbine, fan and booster compressor, said fan and booster compressor being located forward of said core engine and being connected by a second shaft to said low pressure turbine, a system for controlling the temperature of said discs comprising:

means for supplying air from said booster to said bore;

means for supplying air from said high pressure compressor to said bore; and means for controlling the flow of said high pressure compressor air.

14. A system, as recited in claim 13, wherein:

said booster air supply means and said compressor air supply means include a common mixing chamber forward of said forward support structure where said booster air and said compressor air combine to form an air mixture, said chamber being fluidly connected to said rotor bore by a plurality of holes in said forward support structure; and said aft support member has a plurality of metering holes therethrough, said metering holes being sized to reduce the proportion of said booster air in said air mixture when the flow of said compressor air is increased.

15. A system, as recited in claim 14, wherein said compressor air supply means further includes:

a manifold radially outwardly disposed with respect to said high pressure compressor for collecting said compressor air;

a tube connected to said manifold;

a hollow strut between said booster compressor and said high pressure compressor connecting said tube and said common mixing chamber.

16. A system, as recited in claim 15, wherein said valve is disposed within said tube.

17. A system, as recited in claim 13, wherein said control means includes a valve responsive to an engine operating parameter or condition.

18. A system, as recited in claim 13, wherein said booster air supply means and said compressor air supply means include a common mixing chamber forward of said forward support structure where said booster air and said compressor air combine to form an air mixture, said chamber being fluidly connected to said rotor bore by a plurality of metering holes in said forward support structure, said metering holes being sized to reduce the proportion of said booster air in said air mixture when the flow of said compressor air is increased.

19. In a turbomachine having a compressor with a plurality of rotor stages, each stage having a disc which supports a plurality of blades and which extends into a bore cavity, said blades being surrounded in close radial relationship by a stationary shroud and forming a gap therebetween, an improved system for controlling said gap comprising:

means for supplying a first fluid into said bore cavity to cool said discs;

means for supplying a second fluid into said bore cavity to heat said discs; and means for controlling only the flow of said second fluid.

* * * * *